US005397369A

United States Patent [19]

Ohishi

[11] Patent Number: 5,397,369

[45] Date of Patent: Mar. 14, 1995

[54] COATED ABRASIVE ARTICLE AND PROCESS FOR PRODUCING THE SAME

[75] Inventor: Michihiro Ohishi, Woodbury, Minn.

[73] Assignee: Minnesota Mining and Manufacturing Company, St. Paul, Minn.

[21] Appl. No.: 112,536

[22] Filed: Aug. 27, 1993

[30] Foreign Application Priority Data

Oct. 5, 1992 [JP] Japan ..... 4-265905

[51] Int. Cl.[6] ..... B24D 3/02

[52] U.S. Cl. ..... 51/295; 51/298

[58] Field of Search ..... 51/295, 298

[56] References Cited

U.S. PATENT DOCUMENTS

| | | | |
|---|---|---|---|
| 942,808 | 12/1909 | Baekeland | 51/298 |
| 4,047,903 | 9/1977 | Hesse et al. | 51/295 |
| 4,251,408 | 2/1981 | Hesse et al. | 51/298 |
| 4,298,356 | 11/1981 | Teschner et al. | 51/297 |
| 4,690,692 | 9/1987 | Hesse et al. | 51/293 |
| 4,802,896 | 2/1989 | Law et al. | 51/298 |
| 4,871,376 | 10/1989 | DeWald | 51/298 |
| 4,974,373 | 12/1990 | Kawashima et al. | 51/295 |
| 5,110,320 | 5/1992 | Broberg et al. | 51/295 |
| 5,135,546 | 8/1992 | Sato et al. | 51/295 |
| 5,271,964 | 12/1993 | Ohishi | 51/295 |

FOREIGN PATENT DOCUMENTS

| | | |
|---|---|---|
| 0 009 519 | 4/1980 | European Pat. Off. . |
| 0 058 872 | 9/1982 | European Pat. Off. . |
| 0 104 776 | 4/1984 | European Pat. Off. . |
| 0 464 850 | 1/1992 | European Pat. Off. . |
| 0 469 811 | 2/1992 | European Pat. Off. . |
| 0 552 698 | 7/1993 | European Pat. Off. . |
| 28 53 761 | 3/1980 | Germany . |
| 32 26 114 | 8/1981 | Germany . |
| 55-83573 | 6/1980 | Japan . |
| 2087263 | 5/1982 | United Kingdom . |

OTHER PUBLICATIONS

Hawley, *Condensed Chemical Dictionary*, Tenth Edition, 1981, pp. 364, 368, 682 & 1010.

Prof. Dr. Gerhard W. Becker and Prof. Dr. Dietrich Baun 'Kunstsoff-Handbuch. vol. No. 10: Duroplaste (Coord. Prof. Dr. Wilbrand Woebcken)' May 1988, Carl Hanser Verlag, Muncih. DE.

A. Knop et al., *Chemistry and Applications of Phenolic Resins*, Springer-Verlag (1985), pp. 269-280. No month.

*Primary Examiner*—Deborah Jones

*Attorney, Agent, or Firm*—Gary L. Griswold; Walter N. Kirn; David L. Weinstein

[57] ABSTRACT

A coated abrasive product comprising a backing, a first adhesive layer formed on the backing, a layer of abrasive grains formed on the first adhesive layer, and a second adhesive layer covering the layer of abrasive grains, wherein the second adhesive layer is formed from a composition comprising a water soluble resol phenolic resin having a weight-average molecular weight of from 1,400 to 3,500 and an organic solvent having a boiling point of 110° to 175° C., and a process for producing the same. The present invention remarkably shortens a drying time of the second adhesive used in the production of the coated abrasive product of the present invention and improves productivity.

2 Claims, 2 Drawing Sheets

COATED ABRASIVE ARTICLE AND PROCESS FOR PRODUCING THE SAME

BACKGROUND OF THE INVENTION

1. Field of the Invention

The present invention relates to a coated abrasive article and a process for producing the same.

2. Discussion of the Art

Coated abrasive articles (e.g., abrasive cloth and abrasive paper, etc.) are produced by applying a first adhesive on a backing (e.g., paper, cloth, etc.), applying abrasive grains to the first adhesive by electrostatic coating or gravity coating, curing the first adhesive with drying, applying a second adhesive over the first adhesive and abrasive grains, and then curing the second adhesive with drying.

In this case, as the second adhesive, for example, a synthetic resin (e.g., phenolic resin, epoxy resin, urea resin, etc.) or glue is used. Among the foregoing, a water soluble resol phenolic resin is widely used, because it is cheap and is superior in strength and heat resistance. However, the curing rate of the resol phenolic resin is low, and it requires long time for drying and curing. Further, when the resin is cured at a high temperature in order to accelerate drying and curing, boiling of water (as a solvent) as well as vapor of condensate formed on curing cause blisters (or little foams) in the cured resin layer, which results in a decrease of strength. As described above, it is difficult to reduce the drying time.

A relation between percentage of solids in and viscosity of typical resol phenolic resins commercially available in Japan for use as phenolic resins for abrasive cloth and paper is shown in FIG. 1. As is apparent from FIG. 1, resol phenolic resins containing about 65 to 82% solids and having a viscosity of about 700 to 10,000 cps are used for abrasive cloth and paper. Most popularly, water is used as a solvent. A resin in which alcoholic solvent (e.g., methanol, etc.) is partially or exclusively used is also commercially available.

After the second adhesive containing phenolic resin is applied, the second adhesive is cured by heating at a temperature of from about 50° to 110° C. for about 50 minutes to several hours in a festoon oven, which can contain hundreds or thousands meters of web. After the web is wound, the second adhesive is completely cured by heating to a temperature of about 60° to 130° C. for several hours to 20 hours.

On the other hand, in the case of using a short tunnel oven in place of the festoon oven, coating speed and drying speed must be remarkably decreased, and, therefore, productivity becomes low. Accordingly, it is difficult to reduce curing time with the current formulation and curing step.

To improve productivity, there is proposed a method for accelerating heating and curing by applying some modifications and additives to the resol phenolic resin. For example, there is a method comprising the steps of adding another resin to the phenolic resin to accelerate gelation, winding the coated abrasive product, and then curing the phenolic resin by after-cure (post-cure). In Japanese Patent Kokai No. 55-83573, there is proposed that a mixture of a water based resol and a condensate product which is made from a phenol component including phenol or polyfunctional phenol having high reactivity and formaldehyde be used as a binder. Further, a method for accelerating curing by acidifying the resol phenolic resin with an acid such as p-toluenesulfonic acid is also used.

However, the modification of resin or the acceleration of curing causes a decrease of crosslinking density, which results in deterioration of heat resistance. Further, hardness and strength are also decreased.

It would be desirable to shorten the curing time of the second adhesive and to remarkably improve productivity by increasing the molecular weight of a water soluble resol phenolic resin formulated in the second adhesive and selecting an organic solvent suitable for the resin.

SUMMARY OF THE INVENTION

The present invention provides a coated abrasive article comprising a backing, a first adhesive layer formed on the backing, a layer of abrasive grains formed on the first adhesive layer, and a second adhesive layer covering the layer of abrasive grains, wherein the second adhesive layer is formed from an adhesive comprising a water soluble resol phenolic resin having a weight-average molecular weight of from 1,400 to 3,500 and an organic solvent having a boiling point of from 110° to 175° C.

The present invention also provides a process for producing a coated abrasive article comprising the steps of:

(a) applying a first adhesive on a backing to form a first adhesive layer;

(b) applying a layer of abrasive grains on the first adhesive layer;

(c) curing the first adhesive by heating;

(d) applying a second adhesive over the first adhesive layer and the layer of abrasive grains to form a second adhesive layer;

(e) curing the second adhesive layer to form a coated abrasive article;

(f) winding the coated abrasive article; and (g) after-curing (post-curing) the article at a temperature of 60° to 130° C.;

wherein the second adhesive contains a water soluble resol phenolic resin having a weight-average molecular weight of from 1,400 to 3,500 and an organic solvent having a boiling point of from 110°to 175° C. Curing step (e) is preferably conducted at a temperature of from 120° to 160 C. for 1.5 to 3 minutes after the second adhesive is applied.

DETAILED DESCRIPTION

The coated abrasive article of the present invention comprises a backing, a first adhesive layer formed on the backing, a layer of abrasive grains formed on the first adhesive layer, and a second adhesive layer covering the layer of abrasive grains.

As the backing, for example, paper, cloth, or the like is generally used. Film or non-woven fabric, for example, polyethylene terephthalate, may also be used. Further, it is important that the backing have sufficient strength to stand use in a coated abrasive article, as well as suitable flexibility.

The first adhesive layer formed on the backing comprises a synthetic resin (e.g., phenolic resin, epoxy resin, urea resin, etc.) or glue. It is preferred that the first adhesive be dried at a temperature of from 50° to 110° C. for about 30 seconds to several minutes for phenolic resin, at a temperature of from 70° to 140° C. for about 30 seconds to several minutes for urea resin, and at a temperature of from 50° to 110° C. for 30 seconds to several tens of minutes for glue.

A layer of abrasive grains is formed on the first adhesive layer. The layer of abrasive grains can be composed of abrasive grains containing aluminum oxide, silicon nitride, silicon carbide, alumina-zirconia, alumina obtained by sol-gel method as a main component [e.g., "Cubitron" (trade name), manufactured by Minnesota Mining and Manufacturing Company, etc.], garnet, diamond, CBN (cubic boron nitride), and the like, or combinations thereof.

Figure 1:
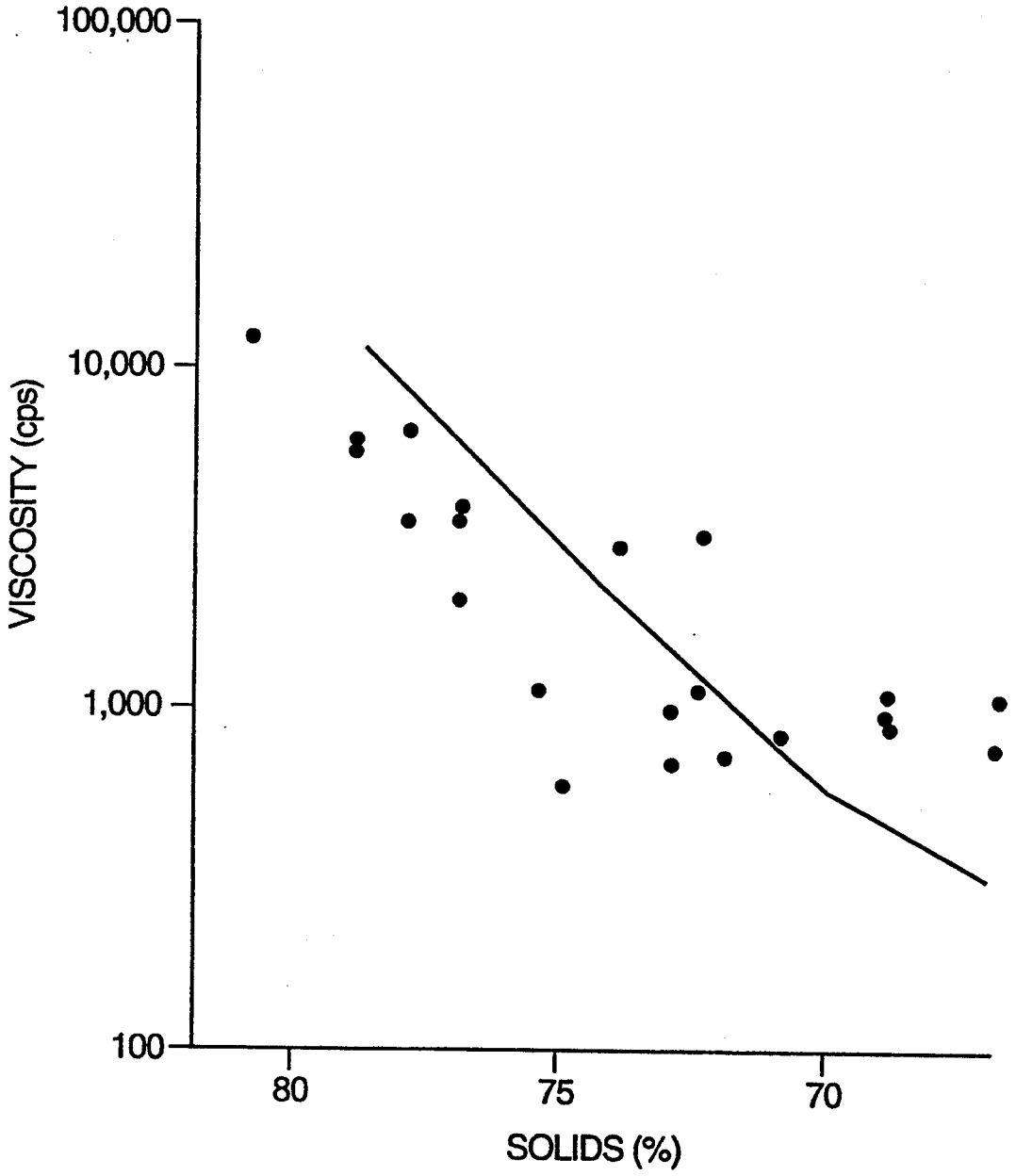
FIG. 1 is a graph illustrating a relation between % solids and viscosity of water soluble resol phenolic resin used in the present invention and commercially available resin
Figure 2:
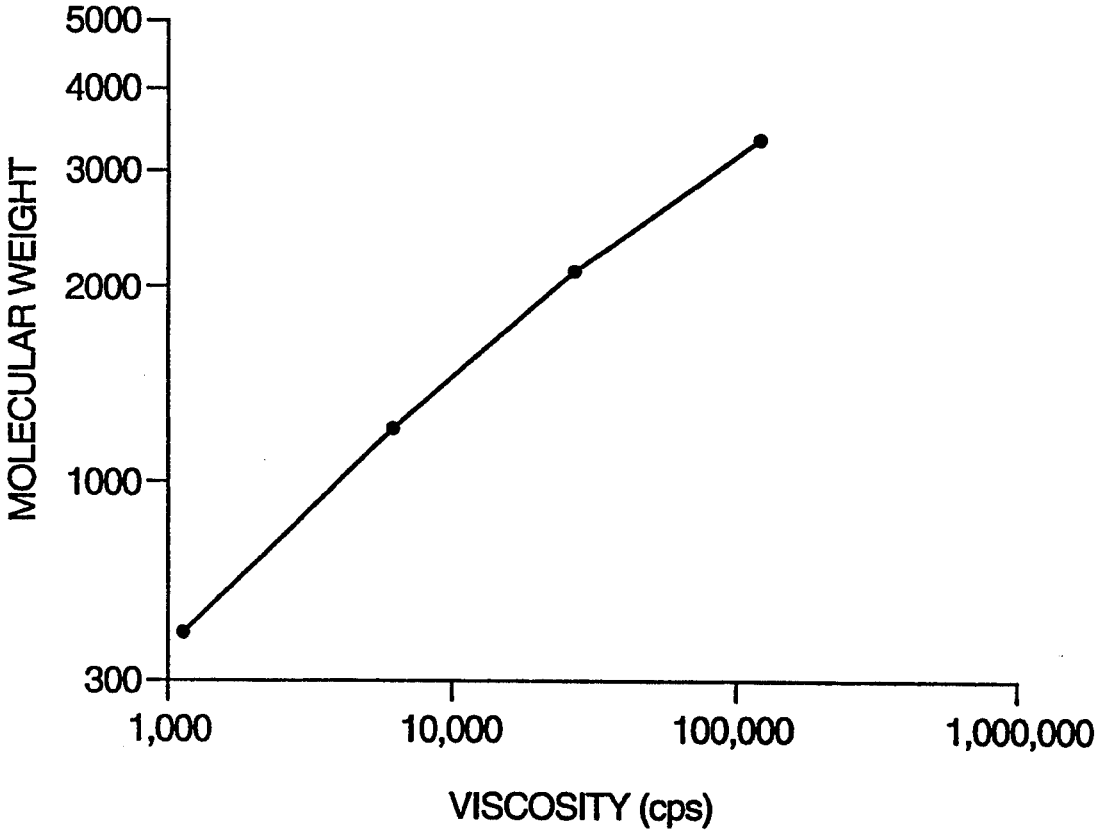
FIG. 2 is a graph illustrating a relation between viscosity and molecular weight of a water soluble resol phenolic resin used in the present invention.

Normally, the coated abrasive article can be formed by applying a layer of the second adhesive on the aforementioned layer of abrasive grains and curing the second adhesive by heating. The second adhesive used in the present invention contains a water soluble resol phenolic resin having a weight-average molecular weight of from 1,400 to 3,500 and an organic solvent having a boiling point of 110° to 175° C. The water soluble resol phenolic resin may be prepared by mixing phenol with formaldehyde to form an aqueous solution and subjecting the solution to the condensation reaction by heating in the presence of a basic catalyst (e.g., sodium hydroxide, potassium hydroxide, etc.). In this process, viscosity and molecular weight of the resin solution can be adjusted by controlling the heating temperature and the heating time. The molecular weight can be measured by GPC (gel permeation chromatography) and the viscosity can be measured by a B type viscometer. A relation between viscosity and weight-average molecular weight of the resol phenolic resin is shown in FIG. 2. In the present invention, the weight-average molecular weight of the resol phenolic resin is from 1,400 to 3,500, that is, it has the viscosity of 10,000 to 100,000, preferably 15,000 to 50,000 cps (25° C.) at 75% solids. When the weight-average molecular weight exceeds 3,500, viscosity becomes high, whereby a large amount of the solvent is required for dilution so as to adjust the viscosity within an appropriate range, and variability in properties of the product becomes large, which is not preferred. On the other hand, when the weight-average molecular weight is less than 1,400, the property of the phenolic resin is the same as that of a conventional second adhesive as shown in FIG. 1, and the drying step is prolonged.

The second adhesive of the present invention also contains an organic solvent having a high boiling point, particularly 110° to 175° C. Examples of organic solvents suitable for the adhesive compositions include cyclohexanol, cyclohexanone, 2-buthoxyethanol, 2-ethoxyethanol, n-butanol, and the like. The organic solvents that are most preferred for the second adhesive of the present invention are cyclohexanone (boiling point of 156° C.) and cyclohexanol (boiling point of 161.1° C.). When a solvent having an excessively high boiling point is used, the solvent is liable to remain in the adhesive layer, which results in insufficient drying. When the boiling point of the solvent is too low, little foams are liable to arise. The larger the force of dissolving the above-mentioned high molecular weight phenolic resin, the better.

If desired any additives such as fillers (e.g., calcium carbonate, silicon oxide, talc, etc.), grinding aids (e.g., cryolite, potassium borofluoride, etc.), colorants (e.g., pigment, dye, etc.), and the like, may be added to the second adhesive in the present invention. The amount of these additives is preferably not more than 70% by weight, based on % solids of the second adhesive. When the amount of additives exceeds 70% by weight, strength of the second adhesive is liable to be decreased.

After the second adhesive thus obtained is coated, for example, by a roll coater, curing is conducted by heating at a temperature of 120° to 160° C. for a short period of time (1.5 to 3 minutes). The coated abrasive article is wound on a jumbo roll according to the same manner as that of a conventional method, and then the coated abrasive article is subjected to an after-cure (post-cure) treatment to obtain a coated abrasive article.

According to the present invention, the curing step following application of the second adhesive can be completed in a remarkably short period of time and productivity can be largely improved. Further, a large drying device is not required as a production facility and the product can be produced by a simple device. The resulting coated abrasive article has the same performance as that of a conventional coated abrasive article.

EXAMPLES

The following Examples and Comparative Examples further illustrate the present invention in detail but are not to be construed to limit the scope thereof. All percentages and parts are by weight unless indicated otherwise.

Preparation of High Molecular Weight Phenolic Resin

A water soluble resol phenolic resin (PR-53074, manufactured by Sumitomo Durez K.K.) was reacted by heating to obtain a high molecular weight resin. Samples of resin PR-53074 were reacted at 45° C. for 5 days, 6 days, and 7 days to obtain a "resin 1", "resin 2", "resin 3", respectively Properties of resin PR-53074 are shown below:

Water soluble phenolic resin PR-53074;

75% solids; viscosity of 720 cps.

Viscosities of resins 1, 2, and 3 and viscosities of solutions thereof when diluted with cyclohexanone (60% solids) are shown in Table 1.

TABLE 1

| | Viscosity (Cps) | | |
|---|---|---|---|
| Measuring temperature (% solids) | Resin 1 [reacted at 45° C., 5 days] | Resin 2 [reacted at 45° C., 6 days] | Resin 3 [reacted at 45° C., 7 days] |
| 45° C. (75 %) (undiluted) | 1,850 | 3,640 | 9,540 |
| 25° C. (75 %) (undiluted) | 20,000 | 41,200 | 123,600 |
| 25° C. (60%) (diluted with cyclohexanone) | 1,135 | 1,640 | 3,630 |

Examples 1 and 2 and Comparative Examples 1 through 4 Coating Condition of the Second Adhesive The composition for the second adhesive solution was made by using PR-53074 and resins 1 to 3. Formulations are shown in Table 2.

TABLE 2

Formulation of the second adhesive (parts by weight)

| Raw Materials | Comp. Ex. 1 | Comp. Ex. 2 | Ex. 1 | Ex. 2 | Comp. Ex. 3 |
|---|---|---|---|---|---|
| PR-53074 (75% solids) | 64 | 64 | — | — | — |
| Resin 1 (60% solids, diluted with cyclohexanone) | — | — | 80 | — | — |
| Resin 2 (60% solids, diluted with cyclohexanone) | — | — | — | 80 | — |
| Resin 3 (60% solids, diluted with cyclohexanone) | — | — | — | — | 80 |
| Water | 17.33 | — | — | — | — |
| Cyclohexanone | — | 17.33 | 21.85 | 10.86 | 34.67 |
| CaCO, (filler) | 52 | 52 | 52 | 52 | 52 |
| % solids | 75 | 75 | 65 | 70 | 60 |

The second adhesive of the articles of Comparative Examples 1 and 2 and Examples 1 and 2 was coated on the sample, which had been subjected to the first adhesive coating step and abrasive grain coating step. In the first adhesive coating step, the first adhesive, an epoxy resin, was applied on a paper backing having a weight of 160 g/m$^2$. Then aluminum oxide abrasive grains (SA FEPA #100; single crystal alumina, manufactured by Showa Denko K.K.) were deposited over the first adhesive layer. The adhesive in the first adhesive layer was cured by heating at a temperature of 120° to 150° C. Changes of the state of cure with time were observed. The state of cure was evaluated according to the following criteria: A, hard; B, tack free; C, slightly tacky; D, tacky. The results are shown in Table 3.

TABLE 3

Relation between heating condition and state of cure of the first adhesive

Comparative Example 1

| Time (min.) | Temperature of Cure 120° C. | 130° C. | 140° C. |
|---|---|---|---|
| 1 | D | D | D |
| 2 | D | D | — |
| 3 | D | A,D | A,D* |
| 5 | A | A (NG) | A (NG) |
| 10 | A | A (NG | A (NG) |

Comparative Example 2

| Time (min.) | Temperature of Cure 120° C. | 130° C. | 140° C. |
|---|---|---|---|
| 1 | D | D | D |
| 2 | D | D | D |
| 3 | D | D | A-C (NG) |
| 5 | C | C | A (NG) |
| 10 | A | A (NG) | A (NG) |

Example 1

| Time (min.) | Temperature of Cure 120° C. | 130° C. | 140° C. | 150° C. |
|---|---|---|---|---|
| 1 | D | D | D | D<br>C (1.5 min.) |
| 2 | D | D | C | B |
| 3 | B | C | B | A (NG) |
| 5 | B | B | A | A (NG) |
| 10 | B | A | A (NG) | — |

Example 2

| Time* (min.) | Temperature of Cure 120° C. | 130° C. | 140° C. | 150° C. |
|---|---|---|---|---|
| 1 | D | D | D | D<br>D (1.5 min.) |
| 2 | C | B | B | B |
| 3 | C | B | A | A |
| 5 | B | B | A | A |
| 10 | A | A | A (NG) | — |

*: hard but tacky
NG: no good because of blister

In the case of using resin PR-53074 without cure or dilution, requisite drying time is 5 minutes or more at a temperature of less than 130° C. although drying time varies depending on the kind of a solvent. On the other hand, in Examples 1 and 2, the cured state (tack free) suitable for winding can be obtained by drying at 150° C. for 2 minutes. In Comparative Example 3, the adhesive had high viscosity even though % solids was decreased to 60%, and, therefore, coating was not conducted.

Sanding Test

A sample of the article of Example 1 and a sample of the article of Comparative Example 4 (formulation of which is shown in Table 4) were prepared by applying the second adhesive on a sample coated with the same first adhesive as that of Example 1 and curing the second adhesive at a temperature of 80° C. for 2 hours, then at a temperature of 90° C. for 2 hours, and then at a temperature of 100° C. for 15 hours. Then, a loop material was laminated on the back surface of the backing, which was punched to form a disc having a diameter of 5 inches. Then, a sanding test was conducted. The results of the test are shown in Table 5.

TABLE 4

Formulation of Comparative Example 4

| Raw Materials | Amount (part by weight) |
|---|---|
| Phenolic resin (78% solids, 600 cps) | 61.54 |
| Water | 13.86 |
| 2-Ethoxyethanol | 5.93 |
| CaCO, (filler) | 52 |
| % Solids | 75 |

TABLE 5

Results of sanding test

| Stock removal | Example 1 | Comp. Example 4 |
|---|---|---|
| (1st) | 13.9 | 14.0 |
| (2nd) | 14.5 | 14.8 |
| Average | 14.2 | 14.4 |

Work piece: steel
Sander: dual action air sander
Load: sander weight + 2 kg
Air pressure: 5 kg/cm$^2$
Sanding time: 5 min. × 6 *times* (*total* 30 *min.*)

As is apparent from Table 5, stock removal by a sample of the article of Example 1 is almost the same as that of a sample of the article of Comparative Example 4 wherein the current second adhesive is used.

Further, physical properties of cured resins were compared. PR-53074 resin and resin 1 were cured at 105° C. for 16 hours by heating and then subjected to a bending test. The bending strength and Young's modulus are shown in Table 6.

TABLE 6

| Results of Bending Test | PR-53074 | Resin 1 |
|---|---|---|
| Bending Strength ($kg/cm^2$) | 1259 | 1331 |
| Young's Modulus ($kg/cm^2$) | 534 | 516 |

As is apparent from Table 6, physical property of resin 1 is almost the same as that of original PR-53074 and it has high strength.

I claim:

1. A process for producing a coated abrasive article comprising the steps of:

(a) applying a first adhesive on a backing to form a first adhesive layer;

(b) applying a layer of abrasive grains on said first adhesive layer;

(c) curing said first adhesive by heating;

(d) applying a second adhesive over said first adhesive layer and said layer of abrasive grains to form a second adhesive layer;

(e) curing said second adhesive layer by heating at a temperature of from 120° to 160° C. for from 1.5 to 3 minutes to form a coated abrasive article;

(f) winding said coated abrasive article; and (g) post-curing said article at a temperature of from 60° to 130° C.;

wherein said second adhesive layer is formed from a composition Comprising a water soluble resol phenolic resin having a weight-average molecular weight of from 1,400 to 3,500 and an organic solvent having a boiling point of from to 175° C.

2. A process for producing a coated abrasive article comprising the steps of:

(a) applying a first adhesive on a backing to form a first adhesive layer;

(b) applying a layer of abrasive grains on said first adhesive layer;

(c) curing said first adhesive by heating;

(d) applying a second adhesive over said first adhesive layer and said layer of abrasive grains to form a second adhesive layer;

(e) curing said second adhesive layer to form a coated abrasive article;

(f) winding said coated abrasive article; and (g) post-curing said article at a temperature of from 60° to 130° C.;

wherein said second adhesive layer is formed from a composition having a viscosity of 10,000 to 100,000 cps (25° C.) at 75% solids and comprising a water soluble resol phenolic resin having a weight-average molecular weight of from 1,400 to 3,500 and an organic solvent having a boiling point of from 110° to 175° C.

* * * * *